United States Patent [19]

Breitbard

[11] 4,105,181

[45] Aug. 8, 1978

[54] TELEPHONE DIRECTORY INFORMATION SUPPORT BRACKET

[75] Inventor: Elford Barnett Breitbard, San Diego, Calif.

[73] Assignee: Tele-Quik, Inc., San Diego, Calif.

[21] Appl. No.: 745,409

[22] Filed: Nov. 26, 1976

Related U.S. Application Data

[63] Continuation-in-part of Ser. No. 677,373, Apr. 15, 1976, abandoned.

[51] Int. Cl.[2] ..... A47B 19/00

[52] U.S. Cl. ..... 248/452; 248/441 C; 248/459; 281/15 B

[58] Field of Search ..... 179/146 R, 178; 40/336; 281/15 B; 24/67.11; 402/60; 248/441 B, 441 C, 442.2, 452, 459, 226.5

[56] References Cited

U.S. PATENT DOCUMENTS

| | | | |
|---|---|---|---|
| 818,602 | 4/1906 | Belden et al. | 179/146R |
| 1,083,915 | 1/1914 | Braucher et al. | 179/146 R |
| 1,113,538 | 10/1914 | Braucher et al. | 179/146 R |
| 2,130,920 | 9/1938 | Faye | 281/15 B |
| 2,879,342 | 3/1959 | Bagley | 179/146 R |
| 3,099,269 | 7/1963 | Sorensen | 24/67.11 |
| 3,166,288 | 1/1965 | Eisenberg | 248/441 C |
| 3,266,819 | 8/1966 | Huff | 40/336 X |
| 3,272,531 | 9/1966 | Krauth | 179/146 R |
| 3,340,635 | 9/1967 | McIntosh | 281/15 B |

FOREIGN PATENT DOCUMENTS

| | | | |
|---|---|---|---|
| 366,278 | 4/1932 | United Kingdom | 402/60 |

*Primary Examiner*—William H. Schultz
*Attorney, Agent, or Firm*—Brown & Martin

[57] ABSTRACT

A bracket for supporting telephone directory information or the like, having an upwardly inclined flat portion that is solely supported on one side edge by a downwardly projecting side member. The lower edge of the side member has a securing device for fitting under and behind the side of a telephone housing and being secured thereto, holding the inclined flat portion in a suspended, projected position for supporting the directory information. A retainer on the upper end of the inclined flat portion holds the directory information and accepts, but yet positively holds, the directory information in position, by employing a U-shaped member having inwardly compressing surfaces, and in another embodiment has an attachment device that wedges within the U-shaped member to hold the directory information in position.

10 Claims, 15 Drawing Figures

TELEPHONE DIRECTORY INFORMATION SUPPORT BRACKET

This application is a continuation-in-part of application Ser. No. 677,373, filed Apr. 15, 1976, now abandoned. The disclosure in that application is herby incorporated in full in this application.

BACKGROUND OF THE INVENTION

There are existing devices that are mounted onto telephone structures for providing quick directory information. These devices are often used to provide directory information in hotels, motels and the like. Such known devices comprise slide mechanisms that fit under the telephone housing and are pulled forward from underneath the telephone for use. With the advent of new dialing information, it is desirable that a telephone directory information support bracket be able to be secured to the telephone housing and so be positioned that the directory information is always within the telephone user's sight. Then the telephone user will become more aware that such directory information exists, and will be more apt to use the information. The foregoing particularly applies to direct dialing information. This information particularly benefits the telephone company as it reduces the amount of personnel time required to handle direct dialed and credit card dialed telephone calls.

The problems with the existing, under the telephone mounted, devices are that these devices are not effectively within the user's view. To use such devices, the user must first recognize or notice the existence of the under the telephone positioned directory and then must slide out the directory to view the information. This unfortunately seldom occurs. Also, the space underneath the telephone for mounting such a slidable device of necessity causes the devices when being moved to directly contact the particular surface, such as a wood cabinet or the like, on which the telephone is positioned. This often mars the surface. Further, the space only allows a limited amount of information to be placed into the directory, and provides little or no support for writing information on paper placed on the directory support.

So it is advantageous to have a new and improved telephone supported directory support, that only only supports directory information but has retainer means that allows quick changing of the directory information from time to time, and for supporting other information such as advertisements or the like, or for supporting pads so that information may be written down about long distance telephone calls made and thus recorded, and which support bracket may be attached to other devices than telephones.

SUMMARY OF THE INVENTION

In a preferred embodiment of this invention, a first flat and rectangular planar member is connected at one of its side edges to a second generally triangularly shaped planar member at one of its side edges. The members are at a normal angle, with the second planar member projecting downwardly and presenting a bottom side edge that when at a level with a horizontal support, positions the first planar member in an upwardly, inclined angle. The lower edge of the second planar member has a securing means that generally comprises hook type members that hook under the side of a telephone housing. This supports the first planar member in an upright, upwardly inclined direction, forming a surface for supporting directory type information, scratch pads and the like. The securing means or members hold the bracket in a secured and solid position against an existing telephone structure. The securing members, in another embodiment, have cooperative adapters for providing attachment to different telephone housing structures. Additionally, means are provided to convert the hook members into a side attachment device for attaching the bracket to the side of a telephone housing, or to the sides of housing of other devices on which the bracket may be used.

The upper end of the bracket has retainer means for securing and holding directory information and other written information, or pads on which information may be written. The retainer means generally comprises a U-shaped member having an open side into which the end of the directory information is placed and which cooperates with means on the upper end of the first planar member for holding the directory information in position. Additionally, a locking bracket or attachment is connected to the directory information and secured into the U-shaped member for retaining loose sheets of information having a total thickness of less than the opening of the U-shaped member.

Additionally, rack means are connected to the undersurface of the first planar member and adjacent the inner surface of the second planar member, for receiving sheets, papers and the like. Thus in use, telephone messages or long distance telephone calls may be recorded on a pad on the upper surface of the first planar member, and then removed and inserted into the rack or shelf underneath the first planar member for storage in connection with that particular telephone on which the bracket is attached.

It is therefore an object of this invention to provide a support bracket for supporting telephone directory information and other information, all of a written nature, or pads upon which information may be written.

It is another object of this invention to provide a new and improved directory information support bracket having adapter means for adapting the support of the bracket to the sides of many different existing telephone housings, or to the sides of other structures, by fitting the bracket against the side wall of the housings.

Another object of the invention is to provide a new and improved directory supporting bracket having securing devices at the upper end of a planar member for effectively, easily, quickly and yet securely holding directory information or the like in replaceable attachment on the bracket.

Other objects and many advantages of this invention will become more apparent upon a reading of the following detailed description and an examination of the drawings, wherein like reference numerals designate like parts throughout and in which.

Figure 1:
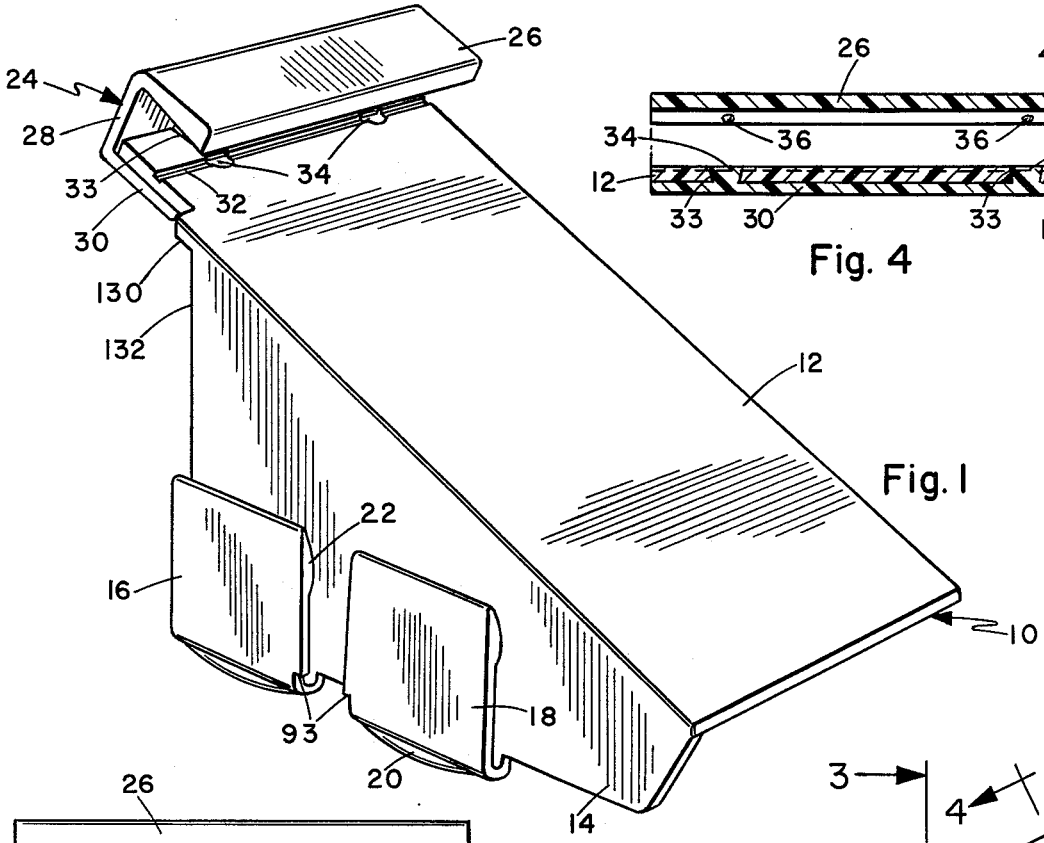
FIG. 1 is a perspective view of the basic configuration of the bracket.

Referring now to FIG. 1, the bracket 10 for supporting information such as telephone directory information, other printed information or writing paper, has a first planar member 12 for supporting the written information on the upper flat surface. A second planar member 14 is secured at one of its side edges of the side edge of the first planar member 12 along line 15. The opposite side edge 17 of the second member 14 has a lower surface that lies in an acute angle with the edge line 15 of the first and second planar members. Thus, the planar member 12 is rectangular and the planar member 14 has a generally triangular shape with the end portion being cut off along the end surface 19.

Figure 7:
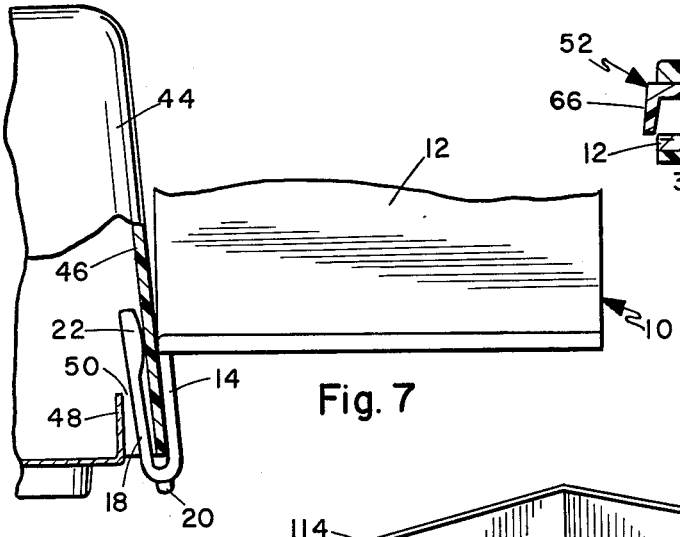
FIG. 7 illustrates the attachment of the bracket to a telephone.
Figure 8:
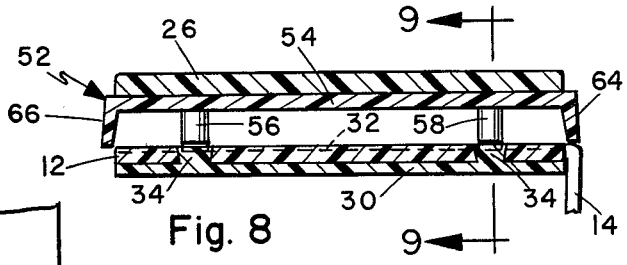
FIG. 8 is a sectional view similar to FIG. 4, showing the insertion of the wedge binder.
Figure 9:
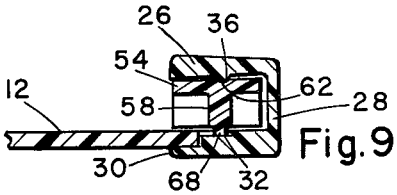
FIG. 9 is a sectional view taken on line 9—9 of FIG. 8.

Securing means, such as the upwardly projecting arms 16 and 18, project upwardly and fit between the bottom plate 48 and the side wall 46 of a known telephone housing 11. See FIG. 7. The upwardly projecting arms 16 and 18 have enlarged upper end portions 22 that fit through space 50 and press against wall 46, sandwiching wall 46 between end projection 22 and the side surface of planar member 14. At the bend of members 16 and 18, are downwardly projecting support surfaces 20. In a normal connection, the compression force on wall 46 is sufficient, coupled with the bending moment of weight on planar member 12, to hold bracket 10 in a suspended position above the surface on which the telephone housing 44 rests. Thus, there is little or no contact between bracket 10 and the horizontal supporting surface. However, should there be vertical movement downwardly of the bracket 10, then the bracket 10 would contact the supporting surface through the nonmarring, bearing surface 20.

Figure 12:
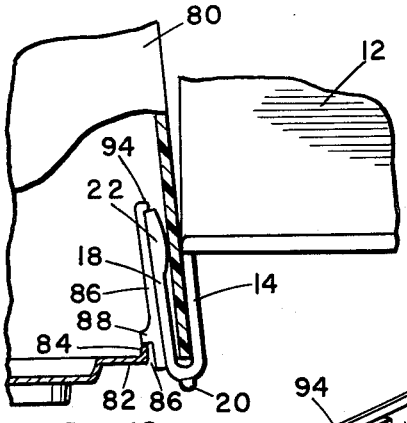
FIG. 12 illustrates attachment of the bracket to another type of telephone, using an adapter clip.

Other telephone housing often have wider spacings between the inner wall 48 and the outer wall 46. An example of the wider spaced structure, see FIG. 12, is in telephone housing 80. In this installation, the space 86 between bottom member 82 and wall member 81 is considerably larger than that in phone 44. In the housing 46 of FIG. 7, the space 50 is normally smaller than the head portion 22 of arm member 18. Thus head portion 22 is wedged through the space 50 and into the space illustrated, tending to lock and hold the bracket member 10 in the upper vertical position. In the installation of FIG. 12, an adapter member 87 is joined with arms 16 and 18 to occupy the space 86 and provide a vertical positive support. Adapter member 87 has an upright planar member with an upper hooked over shoulder 94, a sideward projecting ridge 88, a panel member 92 and a shoulder member 90 with upward notched surfaces 91.

As may be seen in FIG. 1, there is a space between arm members 16 and 18 with notched end portions 93 on the adjacent sides of each of arm members 16 and 18. The adapter member 87 is slidably moved downwardly with center panel member 92 moving through the space between member 16 and 18. The side edges 93 of the member 92 are angled outwardly, thus forming a groove that coacts with the side surfaces of members 16 and 18, to hold the panel member in the attached position in the space. Shoulder member 90 then passes down into the recess formed by notch 93, which mates against the surface 91 locking the panel member 87 in position.

Then in installation the adapter member 87 and arms 16 and 18 are forced through the space 86. The upward end 94 of bottom member 82 then abuts against the lower edge surface of ridge 88, locking the structure in position and vertically holding the bracket 10 a spaced distance above the surface on which the telephone rests.

Figure 14:
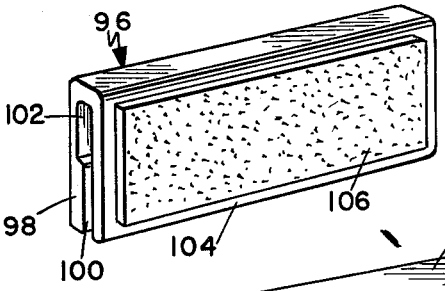
FIG. 14 is a perspective view of an adhesive adapter clip.
Figure 13:
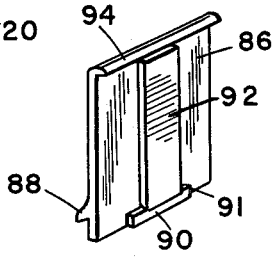
FIG. 13 is a perspective view of the adapter clip.

In another embodiment, see FIG. 14, a U-shaped member 96 has a channel space 102 that is defined by members 98 and 104. Wall 98 has an enlarged end 100. This member 96 is fitted over the upper end of arms 16 and 18, with the enlarged portion 100 moving downwardly below the inward projection 22 that fits into space 102. This ridgedly holds the attachment 96 in the attached position to the side of bracket 10. Surface 106 has an adhesive surface that is securely fixed to the side of, for example, a telephone, computer or other device; firmly securing and supporting the bracket 10 thereto and in a spaced position above the surface on which the telephone, computer, or the like rests.

Figure 5:
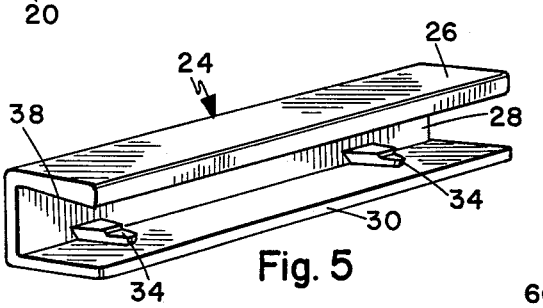
FIG. 5 is a perspective view of the spring clip.

Retainer means are secured to the upper end of the first planar member 12 to hold directory information or loose-leaf type sheet information in position on the planar member 12. In the embodiment of FIG. 1, the retainer means is a U-shaped member 24 having members 26, 28 and 30. Member 30, see FIG. 5, has wedge shaped keys 34. The upper end of the planar member 12 has slots 34, see FIG. 1 and FIG. 12. The ends of the keys 34 and the inner ends of the notches 74 have outwardly expanded radius ends, so that when side 30 is moved against the undersurface of the planar member 12, the ends of the wedge shaped keys move into slots 33 with the ends coacting with recesses 74, thus snapping the side member 30 into abutting connection and holding the U-shaped member 24 in secured position on the planar member 12.

The upper plate member 12 has a groove 32 that passes across the upper surface. The keys 34 have tappered ends, see FIG. 5, that coacts with the grooves 32. The upper member 26 of the U-shaped retainer 24 has a downwardly inclined surface 38 that narrows the slot space between member 38 and the upper surface of the panel member 12. Thus the upper end of the sheets of material 40 when placed into the spaced defined by the U-shaped retainer 24, and are held by the spring action of the U-shaped retainer, i.e. the inclined surface 38. Also projections 36 are in a position to press against the paper for additional retaining force.

Figure 6:
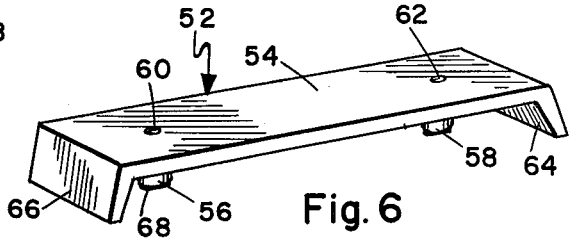
FIG. 6 is a perspective view of a wedge binder.

The sheet material 40 should generally have a thickness that corresponds with the space between the upper member 38 and the panel member 12. In some situations, it may be desirable to have less looseleaf paper than that, such as where the loose sheets may be paper on which information is to be written and removed. So in these situations, the paper would have note book type apertures. These apertures then cooperate with the attachment device 52 of FIG. 6. Attachment device 52 of FIG. 6 has an upper member 54 with downwardly projecting end member 64 and 66. Positioned on the underneath surface of panel member 54 are cylindrical projections 56 and 58 that have notched ends 68. The cylindrical projections 56 and 58 fit through holes in punched out openings in the end of papers 40, thus holding the papers to the attachment device 52. The device 52 is then slidably moved into the space defined by the U-shaped retainer 24, by moving member 52 with the attached paper sheets into the U-shaped opening from the side. The ends 68 of the cylindrical projections 56 and 58 slide in a channel 32 until the attachment device 52 is in position. At this point, recesses 60 and 62 coact with projections 36, to tend to lock and hold the attachment 52 in position wherein the paper sheets 40 are retained in position. These paper sheets may then be removed individually, while still having the remainder of the sheets retained. When it is desired to change the sheets, or to add sheets, then attachment member 52 is slidably removed from the enclosed U-shaped space of retainer 24, and the paper is added over the cylindrical projection 56 and 58, and the attachment 52 is then returned to the lock position holding the paper sheets.

Figure 4:
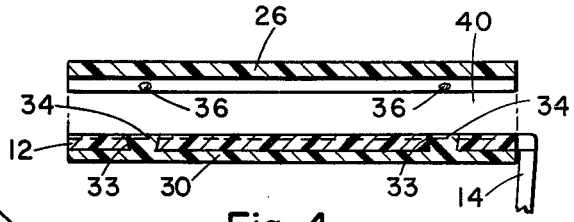
FIG. 4 is a sectional view taken on line 4—4 of FIG. 2.
Figure 3:
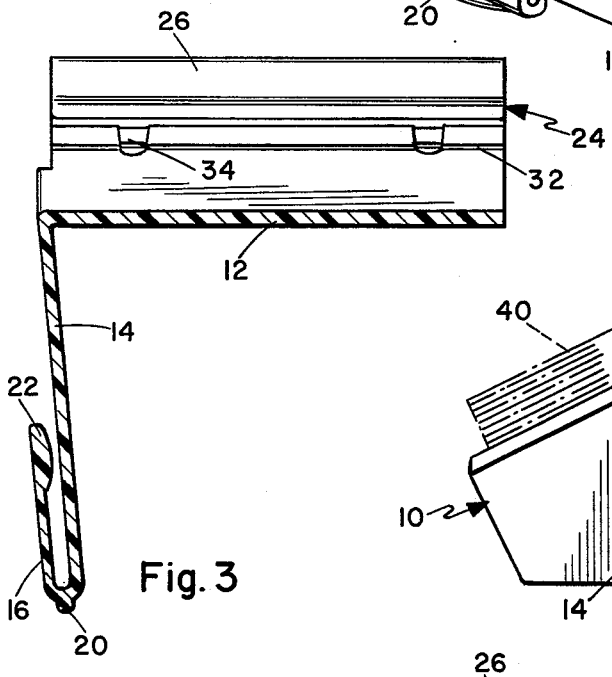
FIG. 3 is a sectional view taken on line 3—3 of FIG. 2.
Figure 2:
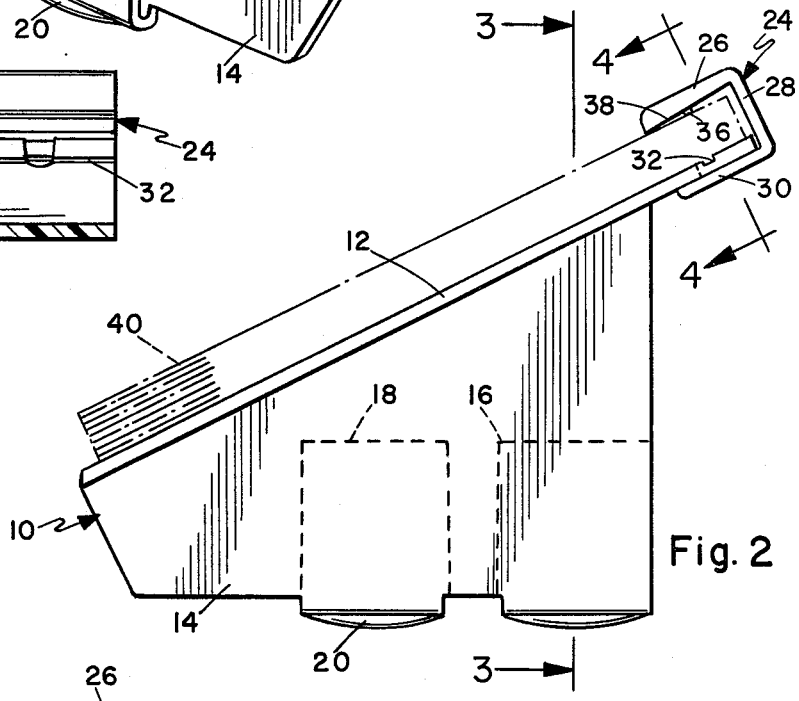
FIG. 2 is a side elevation view thereof.
Figure 15:
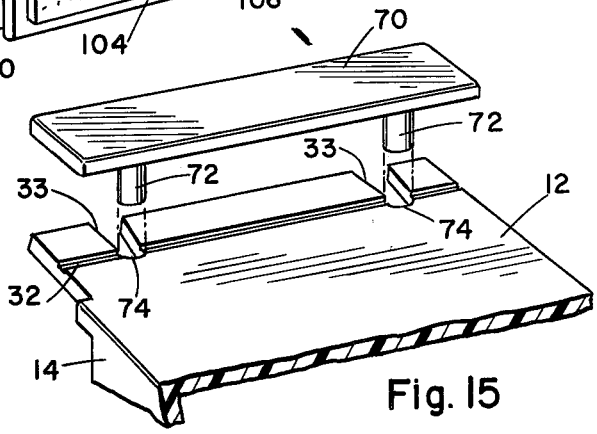
FIG. 15 is a perspective view of a portion of the bracket, showing the attachment of a pin clip.

It is also possible to use a more simplified retainer member as illustrated in FIG. 15, wherein a bar 70 has cylindrical members 72 that fit through note book openings in the upper end of flexible sheets of paper 40. The ends of cylindrical members 72 are then snapped through the openings 74. Members 72 may also be moved into slots 33 in a movement horizontal to the upper panel member 12. The U-shaped bracket member 30 may be secured to the panel member 12 in the manner illustrated and described in FIGS. 3, 4 and 5, or it may be fixed to the lower surface of panel 12 by adhesives, bonding or the like.

Figure 10:
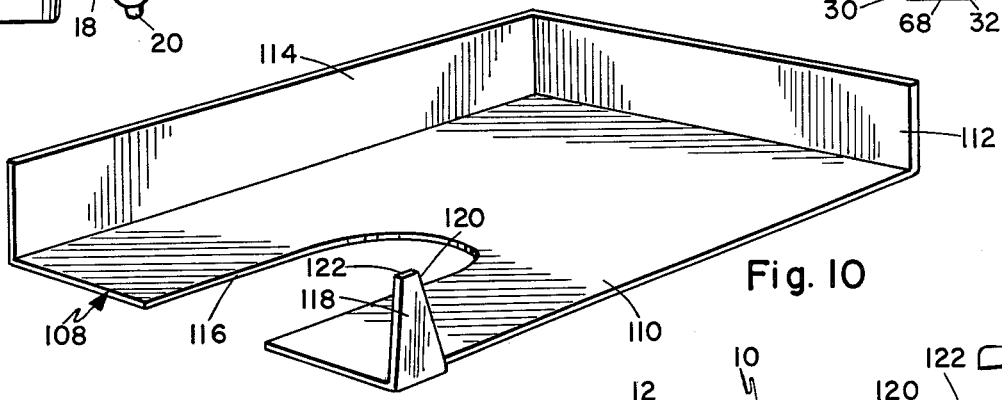
FIG. 10 is a perspective view of a tray for use with the bracket.
Figure 11:
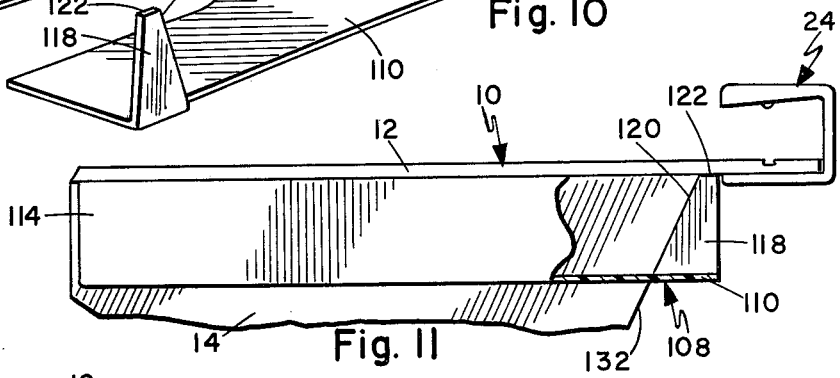
FIG. 11 is a side elevation view showing the attachment of the tray.

Additionally, a shelf member 108 is also secured to the undersurface of upper panel member 12. This shelf member comprises a lower shelf 110 having side members 112 and 114 and an upper ear projecting member 118 with an inclined side surface 120 and an end surface 122. The shelf member 108 is fitted with side edge 111 abutting against the inner surface of panel member 14. This places ear member 118 parallel with the panel member 14 and side edge 120 abutting against side edge 132 and end 122 abutting against notch edge surface 130. See FIGS. 1 and 10. Shelf member 108 is then bonded in this position forming an underneath shelf member for holding papers or the like to the bracket, which shelf member has a slot 116 to facilitate access to papers placed thereon.

Having described my invention, I now claim:

1. A telephone directory information support comprising:

a first planar member for supporting directory information, a second planar member joined at one of its side edges to one of the side edges of said first planar member, the opposite side edge of the second planar member having an acute angle with the line of intersection of the side edges of said first and second planar members, said opposite side edge having securing means for securing said support to the side of a telephone with said opposite side edge being substantially horizontal and said first planar member presenting a flat, upwardly inclined surface for presenting directory information to telephone users, retainer means positioned at the upper inclined end portion of said first planar member for retaining telephone directory information in visible position on said first planar member, said retainer means comprising a U-shaped retainer member with one side of said U-shaped retainer member being secured to the under side of said first planar member with the other side of the U-shaped retainer member projecting above said first planar member for receiving directory information between the other side of the U-shaped retainer member and the first planar member, the lower surface of said other side of said U-shaped retainer member being inclined downwardly at a slight angle toward the free edge, said first planar member having at least one wedge shaped slot in the upper end edge, and said one side of said U-shaped retainer having on its upper surface a wedge shaped key for fitting into said wedge shaped slot and holding said U-shaped retainer to said first planar member.

2. A telephone directory information support as claimed in claim 1:

said upper end of said first planar member within the volume defined by said U-shaped retainer having a groove extending across the width of the upper surface of said first planar member, attachment means comprising a plate having downwardly projecting end legs, which end legs have a length slightly larger than the minimum distance between the other side of said U-shaped retainer and the upper surface of said first planar member, at least a pair of pins extending downwardly from the plate and having tapered ends for riding in said slot;

said pins having a diameter smaller than holes in the paper for holding the paper in position, whereby said attachment is slidably positioned under the U-shaped retainer between the other side and the first planar member for retaining loose leaf pages on the first planar member.

3. A telephone directory information support as claimed in claim 2:

the underneath surface of the other side of the U-shaped retainer having downward projections, and the upper surface of said plate of said attachment having recesses for receiving said projections, whereby said projections are positioned in said recesses when said attachment is in position for holding said attachment in the correct position.

4. A telephone directory information support comprising:

a first planar member for supporting directory information, a second planar member joined at one of its side edges to one of the side edges of said first planar member, the opposite side edge of the second planar member having an acute angle with the line of intersection of the side edges of said first and second planar members, said opposite side edge having securing means for securing said support to the side of a telephone with said opposite side edge being substantially horizontal and said first planar member presenting a flat, upwardly inclined surface for presenting directory information to telephone users, retainer means positioned at the upper inclined end portion of said first planar member for retaining telephone directory information in visible position on said first planar member, said retainer means comprising a U-shaped retainer member with one side of said U-shaped retainer member being secured to the under side of said first planar member with the other side of the U-shaped retainer member projecting above said first planar member for receiving directory information between the other side of the U-shaped retainer member and the first planar member, the lower surface of said other side of said U-shaped retainer member being inclined downwardly at a slight angle toward the free edge, said securing means comprising at least a pair of spaced apart, upwardly directed leg members that are spaced from said second planar member and that are secured at the lower ends to the lower edge of said second planar member, the upper end of said leg members having an enlarged end portion for contacting the side of a support member position between the enlarged end portion and the second planar member, an adapter panel having fixed on one side a second panel that is slidably positioned in the space between said leg members and having means for being secured thereto, and the lower portion of said panel on the side opposite said leg members having a lower ridge for coacting with a bottom wall edge of the telephone.

5. A telephone directory information support as claimed in claim 4:

said adapter panel having an upper shoulder for fitting against the upper surface of said leg members and preventing downward movement of said adapter relative to said leg members and said first and second planar members.

6. A telephone directory information support as claimed in claim 5:

the surface of said adapter panel adjacent said leg members having a lower shoulder for fitting into a notch in the lower portion of said leg member locking said adapter panel in position.

7. A telephone directory information support comprising:

a first planar member for supporting directory information, a second planar member joined at one of its side edges to one of the side edges of said first planar member, the opposite side edge of the second planar member having an acute angle with the line of intersection of the side edges of said first and second planar members, said opposite side edge having securing means for securing said support to the side of a telephone with said opposite side edge being substantially horizontal and said first planar member presenting a flat, upwardly inclined surface for presenting directory information to telephone users, retainer means positioned at the upper inclined end portion of said first planar member for retaining telephone directory information in visible position on said first planar member, said retainer means comprising a U-shaped retainer member with one side of said U-shaped retainer member being secured to the under side of said first planar member with the other side of the U-shaped retainer member projecting above said first planar member for receiving directory information between the other side of the U-shaped retainer member and the first planar member, the lower surface of said other side of said U-shaped retainer member being inclined downwardly at a slight angle toward the free edge, said securing means comprising at least a pair of spaced apart, upwardly directed leg members that are spaced from said second planar member and that are secured at the lower ends to the lower edge of said second planar member, the upper end of said leg members having an enlarged end portion for contacting the side of a support member position between the enlarged end portion and the second planar member, a U-shaped member comprising two side members with one of said side members having an inwardly directed enlarged end portion, said U-shaped member fitting over the leg members with the inwardly directed enlarged end portion fitting below the enlarged end portion of said leg members locking the U-shaped member in position on the leg members with the leg members enclosed within the U-shaped member, and the side of the said U-shaped member having attachment means for attaching the information support to the side of a telephone housing.

8. A telephone directory information support comprising:

a first planar member for supporting directory information, a second planar member joined at one of its side edges to one of the side edges of said first planar member, the opposite side edge of the second planar member having an acute angle with the line of intersection of the side edges of said first and second planar members, said opposite side edge having securing means for securing said support to the side of a telephone with said opposite side edge being substantially horizontal and said first planar member presenting a flat, upwardly inclined surface for presenting directory information to telephone users, retainer means positioned at the upper inclined end portion of said first planar member for retaining telephone directory information in visible position on said first planar member, said retainer means comprising a retainer member being secured to said first planar member with an end member and a connected other side member projecting above said first planar member from said end member for receiving directory information between the other side of the retainer member and the first planar member, the lower surface of said other side of said retainer member being inclined downwardly at a slight angle toward the free edge, said upper end of said first planar member within the volume defined by said other side and end member of the retainer member having a groove extending across the width of the upper surface of said first planar member, Attachment means comprising a plate having downwardly projecting end legs, which end legs have a length slightly larger than the minimum distance between the other side of said retainer member and the upper surface of said first planar member, at least a pair of pins extending downwardly from the plate and having ends for riding in said slot, said pins having a diameter smaller than holes in the paper for holding the paper in position, whereby said attachment is slidably positioned under the retainer between the other side member and the first planar member for retaining loose leaf pages on the first planar member.

9. A telephone directory information support comprising:

a first planar member for supporting directory information, a second planar member joined at one of its side edges to one of the side edges of said first planar member, the opposite side edge of the second planar member having an acute angle with the line of intersection of the side edges of said first and second planar members, said opposite side edge having securing means for securing said support to the side of a telephone with said opposite side edge being substantially horizontal and said first planar member presenting a flat, upwardly inclined surface for presenting directory information to telephone users, retainer means positioned at the upper inclined end portion of said first planar member for retaining telephone directory information in visible position on said first planar member, said securing means comprising at least a pair of spaced apart, upwardly directed leg members that are spaced from said second planar member and that are secured at the lower ends to the lower edge of said second planar member, the upper end of said leg members having an enlarged end portion for contacting the side of a support member position between the enlarged end portion and the second planar member, an adapter panel having fixed on one side a second panel that is slidably positioned in the space between said leg members and having means for being secured thereto, and the lower portion of said panel on the side opposite said leg members having a lower ridge for coacting with a bottom wall edge of the telephone.

10. A telephone directory information support as claimed in claim 8, wherein:

said adapter panel has an upper shoulder for fitting against the upper surface of said leg members and preventing downward movement of said adapter relative to said leg members and said first and second planar members, and the surface of said adapter panel adjacent said leg members has a lower shoulder for fitting into a notch in the lower portion of said leg member locking said adapter panel in position.

* * * * *